US012636564B1

(12) United States Patent
Lin

(10) Patent No.: US 12,636,564 B1
(45) Date of Patent: May 26, 2026

(54) BIKE TRAINER WITH AUTO GRADIENT SIMULATOR

(71) Applicant: Lily Lin, Yuanshan Township (TW)

(72) Inventor: Lily Lin, Yuanshan Township (TW)

( * ) Notice: Subject to any disclaimer, the term of this patent is extended or adjusted under 35 U.S.C. 154(b) by 64 days.

(21) Appl. No.: 18/956,329

(22) Filed: Nov. 22, 2024

(51) Int. Cl.
*A63B 69/16* (2006.01)
*A63B 24/00* (2006.01)

(52) U.S. Cl.
CPC ..... *A63B 69/16* (2013.01); *A63B 24/0087* (2013.01); *A63B 2069/165* (2013.01)

(58) Field of Classification Search
CPC ..... A63B 69/16; A63B 24/0087; A63B 2069/165
See application file for complete search history.

(56) References Cited

U.S. PATENT DOCUMENTS 6,712,737 B1 * 3/2004 Nusbaum ..... A63B 69/16 482/8
7,226,395 B2 * 6/2007 Wu ..... A63B 69/16 482/61
11,395,948 B2 * 7/2022 Hawkins, III ..... A63B 22/0023
2007/0004565 A1 * 1/2007 Gebhardt ..... A63B 69/16 482/61
2010/0062909 A1 * 3/2010 Hamilton ..... A63B 24/0087 482/61
2011/0039664 A1 * 2/2011 Cooper ..... A63B 24/0087 482/61
2016/0236055 A1 * 8/2016 Kalogiros ..... A63B 21/00178
2019/0134480 A1 * 5/2019 Liao ..... H02J 7/1407
2021/0228939 A1 * 7/2021 McAllister ..... A63B 22/0605
2022/0203198 A1 * 6/2022 Sartore ..... A63B 71/023

* cited by examiner

*Primary Examiner* — Andrew S Lo
(74) *Attorney, Agent, or Firm* — Birch, Stewart, Kolasch & Birch, LLP

(57) ABSTRACT

A bike trainer with auto gradient simulator, which is a bike frame combines the gradient adjustment device with the main frame, eliminating the requirement of installing another independent climbing training device, and combines with the smart trainer to form a whole training equipment. The bike trainer can respond to the gradient commands of the virtual cycling software 60 and can automatically adjust the angle with the ground plane according to the commands. The gradient adjustment device is arranged on the same axis as the hollow tube. Therefore, unlike the prior art, the feeling of displacement on the two axis is different. The present invention provides the feeling closer to the actual riding when going uphill and downhill.

8 Claims, 22 Drawing Sheets

BIKE TRAINER WITH AUTO GRADIENT SIMULATOR

BACKGROUND OF THE INVENTION

1. Field of the Invention

A bike trainer, especially to one that can automatically simulate gradient according to the virtual cycling software command, and can automatically adjust the angle with the ground plane according to the command of the app.

2. Description of the Related Art

As showing in FIG. 1, which disclosed wheel-on bike trainer and a direct-drive bike trainer 50*b*, both of them are smart bike trainer 50, it is a kind of fitness equipment for indoor cycling training. It can simulate the real riding experience, provide users with riding resistance, and measure the user's output power at the same time. In recent years, due to the increasing maturity of technology and the reduction of prices, smart bike trainers 50 have gradually become popular in the market. When using the current smart bike trainer 50, it is usually necessary to remove the rear wheel of the bicycle 10, and then install the bottom bracket 16 of the bicycle on the smart bike trainer 50, as showing in FIG. 2.

The smart bike trainer currently on the market has relatively simple functions. Some conventional smart bike trainers allow users to modify the resistance provided by the smart bike trainer. While resistance changes can be used to roughly estimate the effort required to overcome certain terrains, many conventional smart trainers do not change the orientation of the bike to simulate the gradient corresponding to the terrain. Therefore, the rider is not generally placed in the same position that he would encounter when actually riding on such terrain. Therefore, it will prevent the rider from accurately simulating road or trail riding, or other height changes that the rider may encounter during actual riding, so there is still room for improvement.

As FIG. 3A~3C showing, U.S. Pat. No. 11,395,948B2, disclosed a climbing trainer 100 includes a housing 102 and a curved base 104. Disposed within the housing 102 is a shuttle 106 that linearly translates within the housing 102. the climbing trainer 200 includes a drive assembly 17 adapted to move the shuttle 106 within the housing 102 along the axis (X-X) 200.

However, the climbing trainer 100 as showing in FIG. 3B is an independent device, it combines with the front bracket 17 of the bike 10, the movement of the front bracket 17 is along the X-X axis of the climbing trainer 100 instead of Y-Y axis of the front bracket 17, so it is slightly different from the actual feeling of riding a bicycle up and downhill, and lacks real situational experience.

Moreover, as FIG. 3C showing, the climbing trainer 100 above mentioned includes a motor 222, a gear assembly 224, a belt 226, and a tensioner pulley 228 to drive the movement of the shuttle 106. However, the shuttle 106 must bear the weight of the bike 10 and the rider, then using the belt 226 to pull the shuttle 106 up and down, it is easy to slip and cause the lifting position cannot be quick and accurate.

SUMMARY OF THE INVENTION

A primary objective of the present invention is to provide a bike trainer with auto gradient simulator, which combines the gradient adjustment device with the bike frame, this bike frame with the gradient adjustment device can apply with a bike trainer to form a complete fitness equipment.

In order to achieve the above objective, the present invention includes a main frame, having a saddle and a handlebar; a rear wheel, arranged at the rear side of the main frame, and the rear wheel can be taken off from the main frame; a drive system, arranged on the main frame, for driving the rear wheel.

Wherein: a hollow tube extends downward from the front end of the main frame, and a symmetrical lock hole is provided on both sides of the hollow tube close to the bottom; a gradient adjustment device, sleeved on the axis of the hollow tube, includes: a base seat, arranged at the bottom end of the gradient adjustment device, its bottom surface is in contact with the ground, and its upper end surface is provided with an opening; a telescopic slide tube, its bottom end is fixed on the opening of the base seat, and two axial slide grooves are symmetrically provided on both sides, and its upper end extends into the hollow tube and can telescopically slide in the hollow tube; an adjusting screw, arranged in the telescopic slide tube, and its bottom end is positioned in the base seat; a nut, sleeved on the adjusting screw, and a screw hole is provided on both sides of the nut relative to the lock hole of the hollow tube; two positioning screws are used to fix the nut on the inside of the hollow tube through the lock hole and the screw hole; a drive motor, arranged in the base seat to drive the adjusting screw to rotate forward or reverse; an encoder, arranged around a shaft of the drive motor, for sensing the rotational state of the drive motor; a micro computer unit, arranged in the base seat and electrically connect to the drive motor and the encoder, for controlling the drive motor to rotate forward or reverse, then further drive the adjusting screw to rotate forward or reverse, so as to driving the nut to move upward or downward relative to the adjusting screw, thereby causing the telescopic slide tube to be in a telescopic state relative to the hollow tube; whereby the gradient adjustment device can be telescopic on the axis inside the hollow tube, so that the main frame is raised or fell to simulate the situation of cycling uphill or downhill.

Also, the bottom edge of the base seat forwardly forms an arc surface.

Also, the drive motor is arranged at the front side of the base seat, and a reduction gear set is arranged between the bottom of the adjusting screw and the drive motor, the drive motor drives the adjusting screw to rotate through the reduction gear set.

Also, further includes a control system arranged on the main frame, the control system is electrically connected to the micro computer unit.

Also, the gradient adjustment device further includes a transmission unit and a memory unit electrically connected to the micro computer unit, and a power circuit to provide the power required by the gradient adjustment device.

Also, the nut is symmetrically provided with two protruding parts on both sides with the screw hole, and the two protruding parts can slide up and down in the two axial slide grooves.

Also, the main frame can be combined with the wheel-on bike trainer.

Also, wherein the main frame can take off the rear wheel and be combined with the direct-drive bike trainer.

With the features above disclosed, the present invention has below effects:

1. The present invention combines the gradient adjustment device with the main frame, eliminating the requirement of installing another independent climbing training device as in the prior art, and has the effect of saving space.

2. Moreover, the gradient adjustment device of the present invention is arranged on the same axis as the hollow tube. Therefore, unlike the prior art, the feeling of displacement on the two axis is different. The present invention provides the feeling closer to the actual riding when going uphill and downhill.

3. The gradient adjustment device of the present invention is not driven by a belt, but uses an adjusting screw, a nut and an encoder to adjust the gradient. Therefore, solving the disadvantage that the belt drive is easy to slip, and it has the effect of rapid adjustment and accurate gradient position.

DETAILED DESCRIPTION OF THE PREFERRED EMBODIMENT

Figure 1:
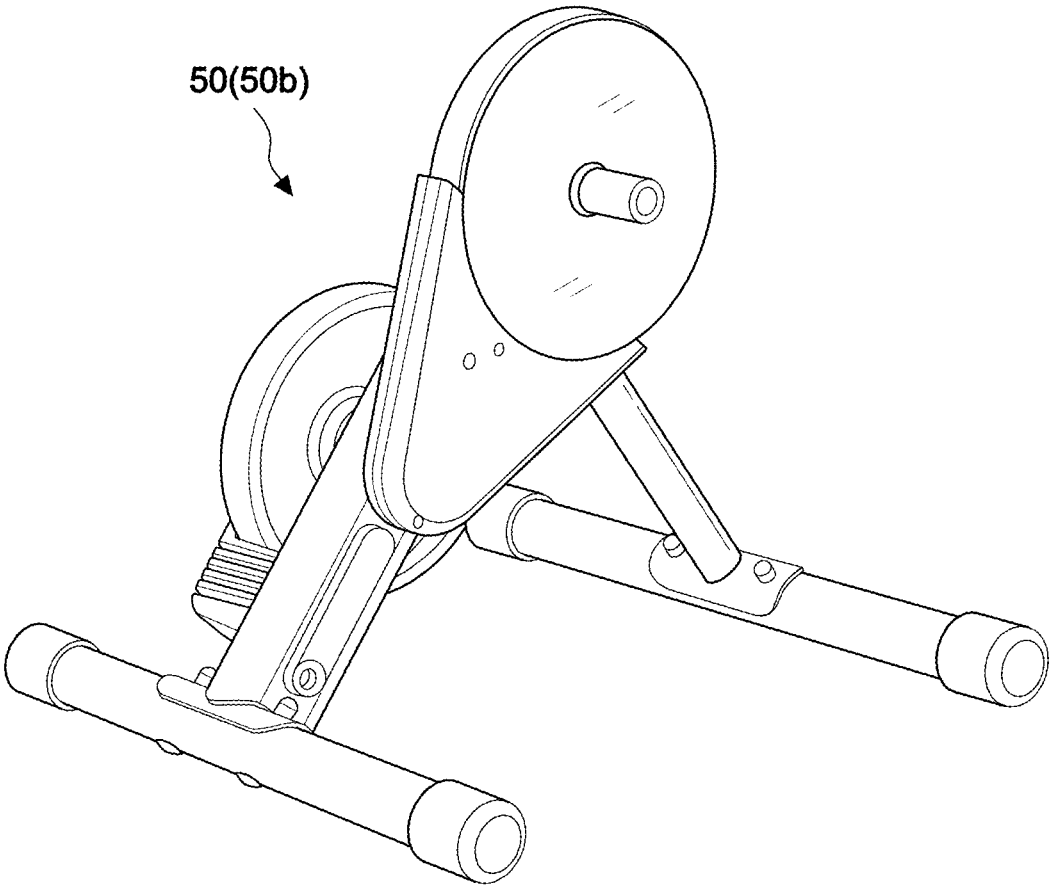
FIG.1 PRIOR ART
FIG. 1 is a prospective view of the prior art.
Figure 2:
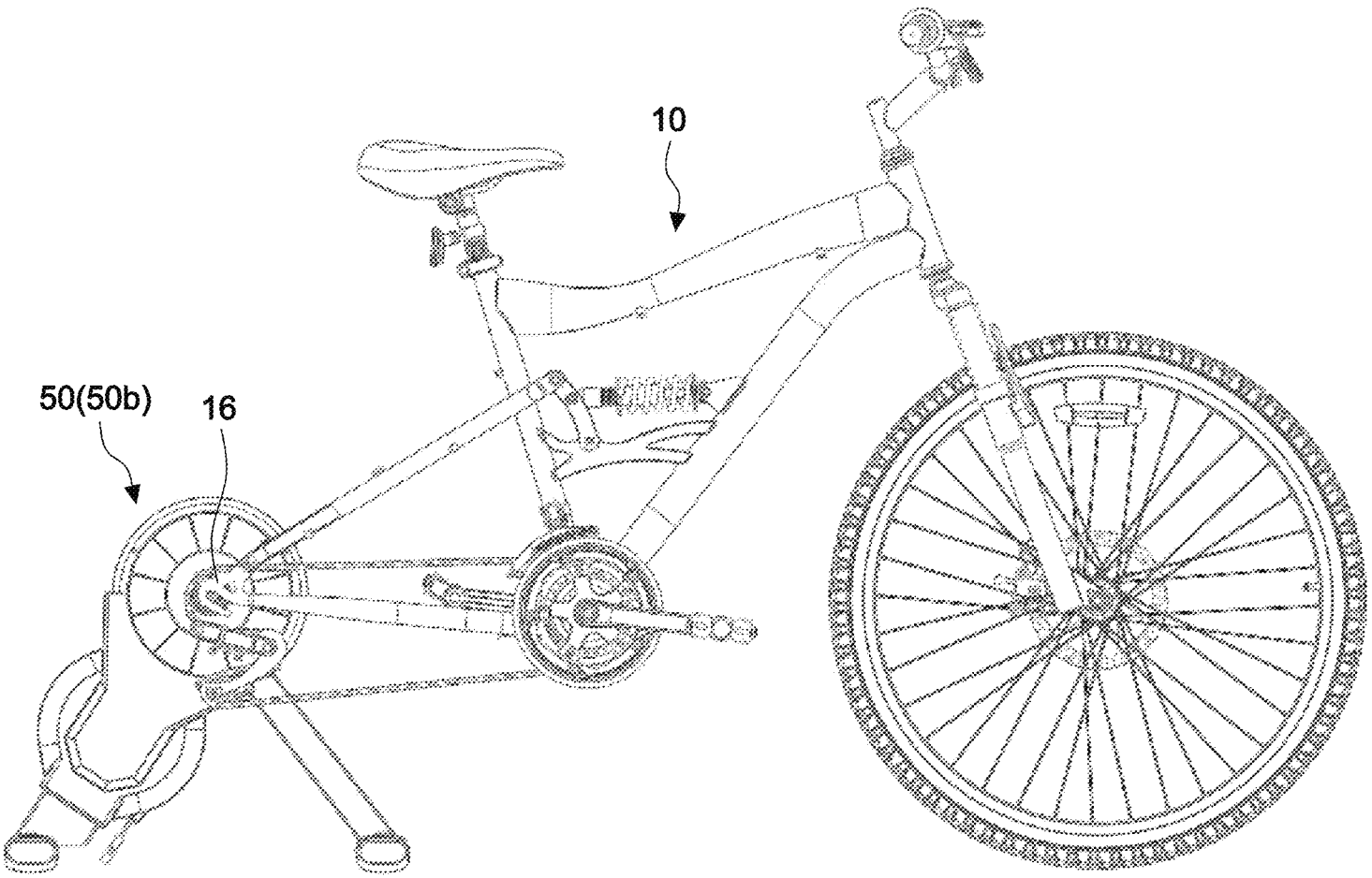
FIG.2 PRIOR ART
FIG. 2 is a schematic diagram illustrating the application of the prior art.
Figure 3A:
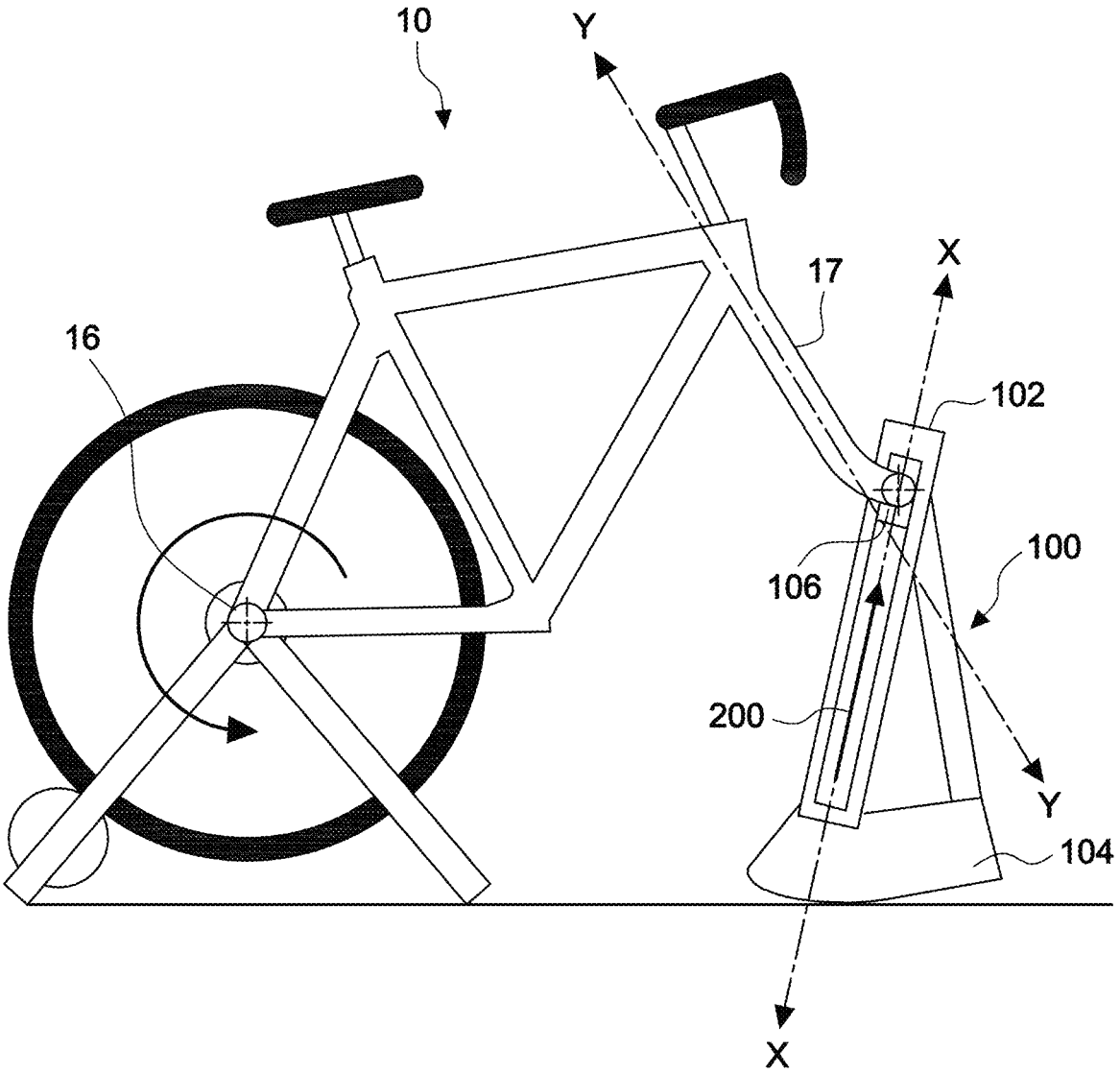
FIG.3A PRIOR ART
FIG. 3A is a schematic diagram illustrating the application of the prior art, U.S. Pat. No. 11,395,948B2.
Figure 3B:
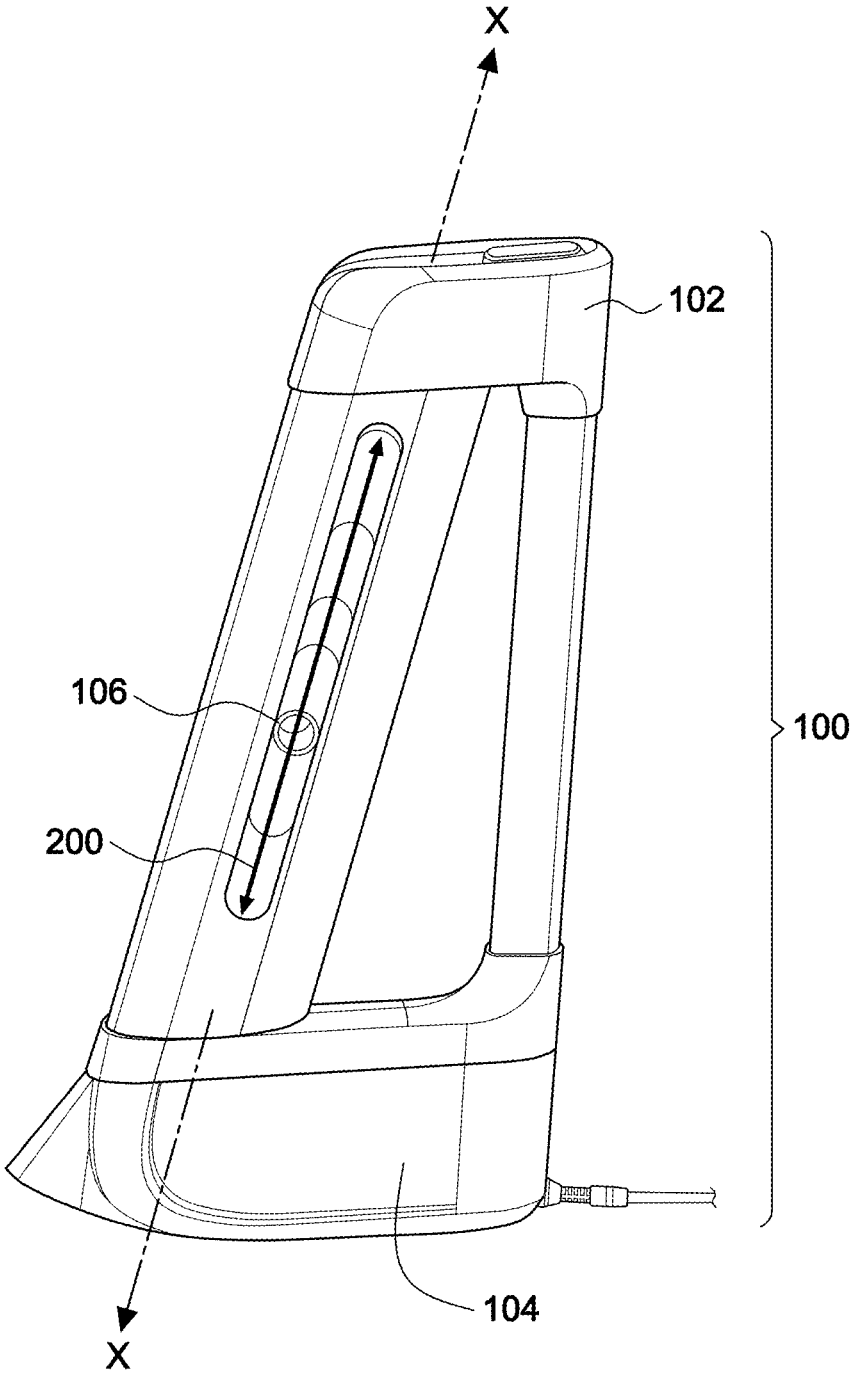
FIG.3B PRIOR ART
FIG. 3B is a schematic diagram illustrating the climbing trainer of the prior art, U.S. Pat. No. 11,395,948B2.
Figure 3C:
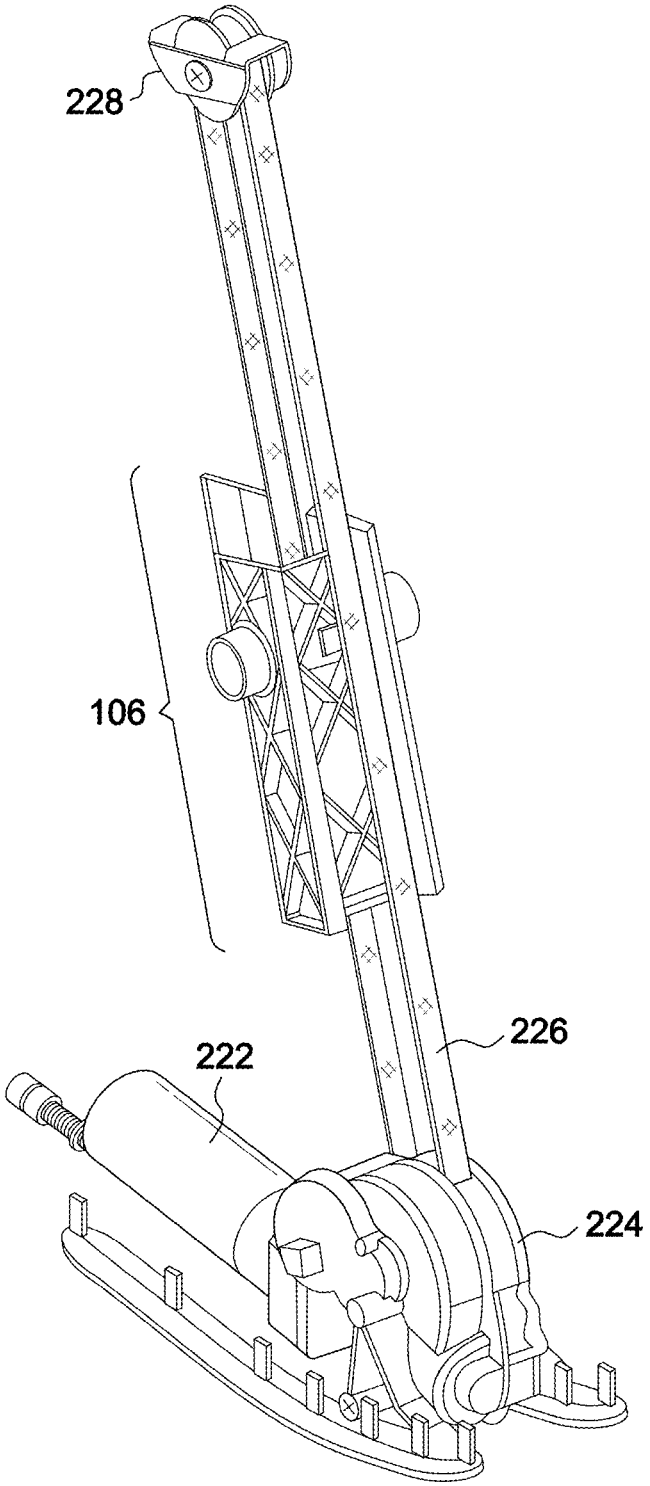
FIG.3C PRIOR ART
FIG. 3C is a schematic diagram illustrating the structure of the prior art, U.S. Pat. No. 11,395,948B2.
Figure 4A:
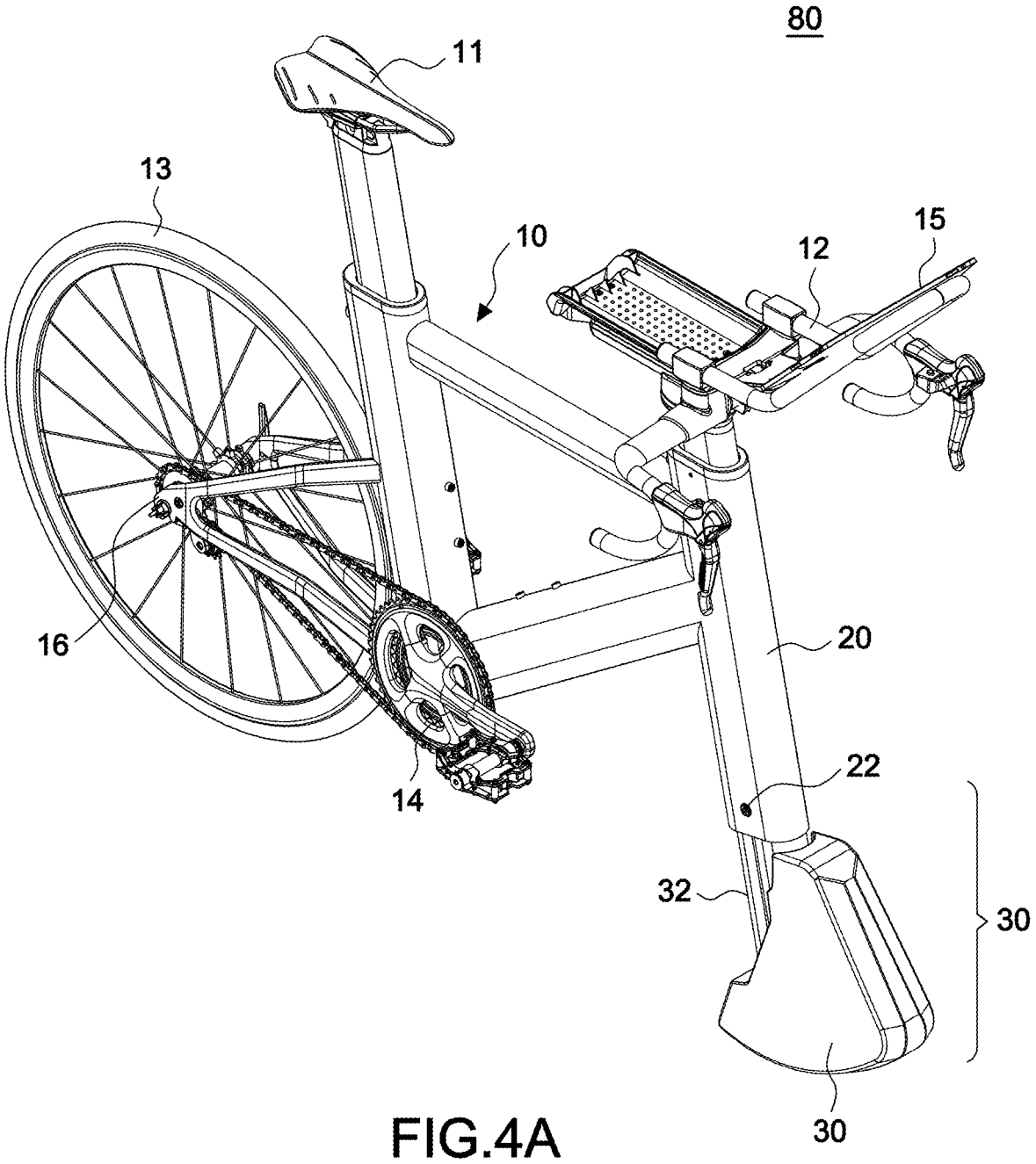
FIG. 4A is a prospective view of the preferred embodiment of the present invention.
Figure 4B:
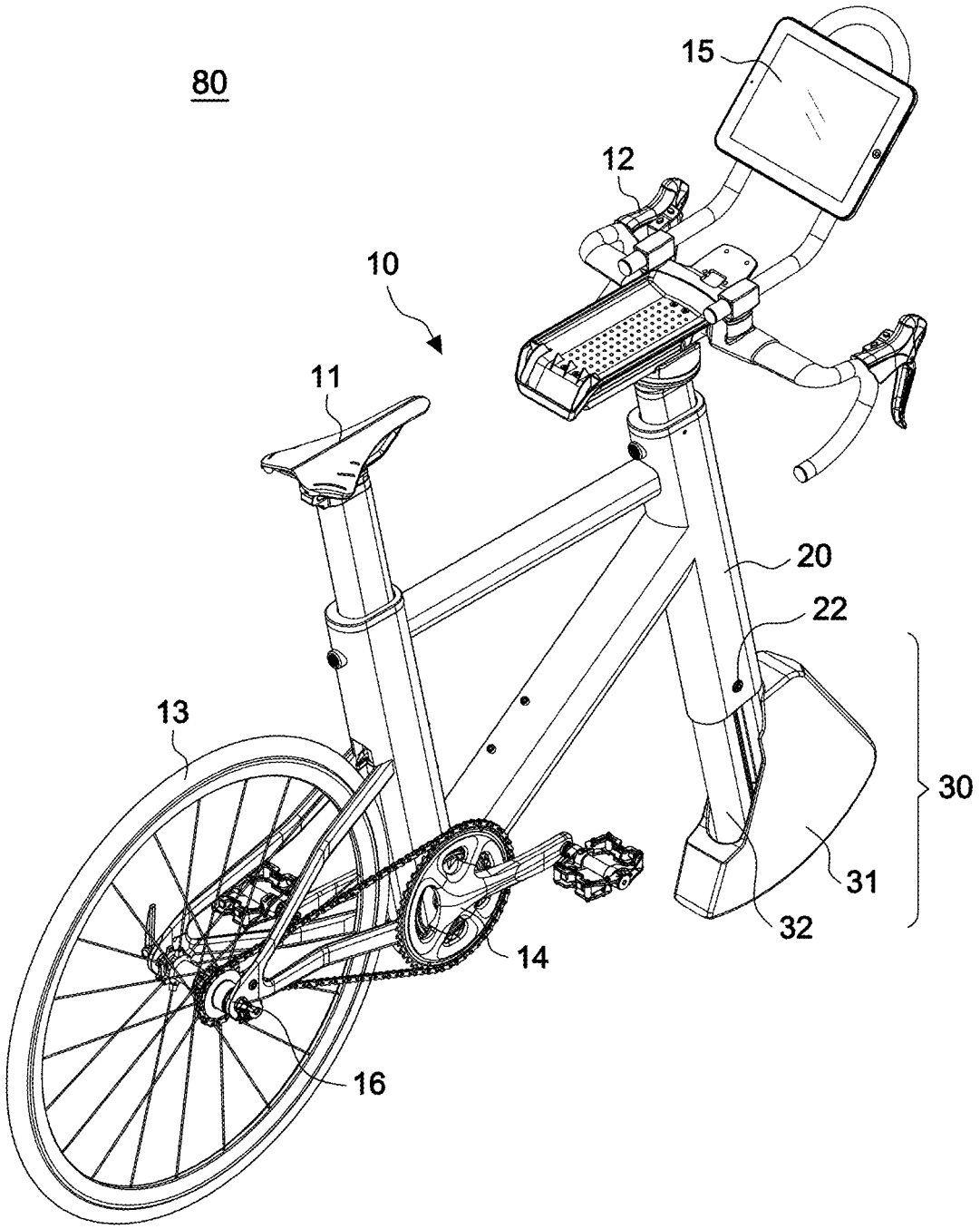
FIG. 4B is a prospective view of the preferred embodiment of the present invention.
Figure 4C:
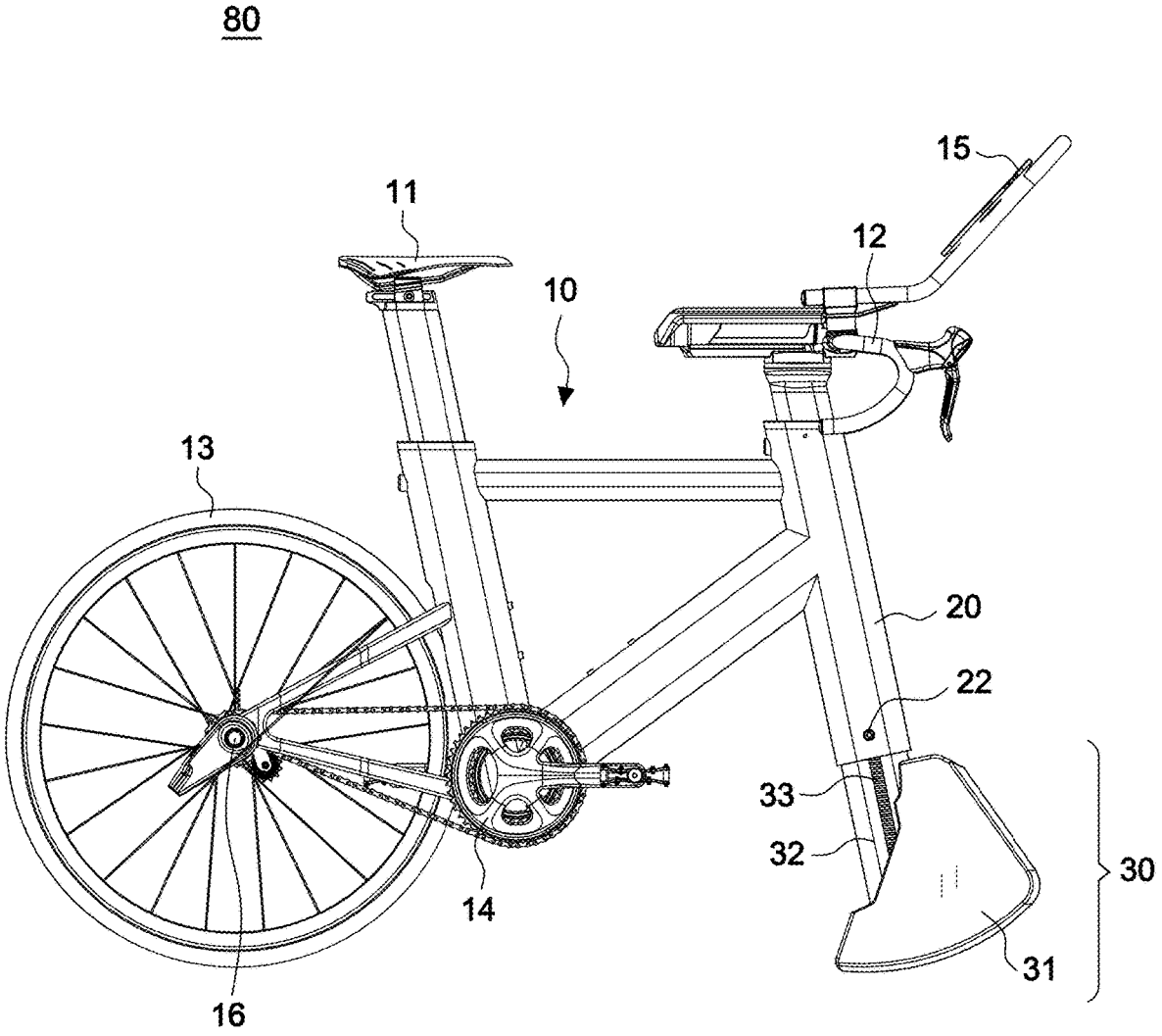
FIG. 4C is a side view of the preferred embodiment of the present invention.

Referring to FIGS. 4A~15, the the bike trainer with auto gradient simulator 80 includes: a main frame 10, having a saddle 11 and a handlebar 12; a rear wheel 13, arranged at the rear side of the main frame 10, and the rear wheel 13 can be taken off from the main frame 10; a drive system 14, arranged on the main frame 10, for driving the rear wheel 13; however, these features are well known in prior art, so will not be disclosed in detailed here.

The present invention is to provide a frame device that replaces an indoors bicycle frame that can be installed on the smart bike trainer 50. Its basic structure is similar to a bicycle, but the front wheel of the original bicycle is replaced by a set of height adjustment mechanisms that can automatically respond to commands.

Therefore, the main features of the present invention are: a hollow tube 20 extends downward from the front end of the main frame 10, and a symmetrical lock hole 21 is provided on both sides of the hollow tube 20 close to the bottom; a gradient adjustment device 30, sleeved on the axis (Y-Y) of the hollow tube 20.

Figure 9:
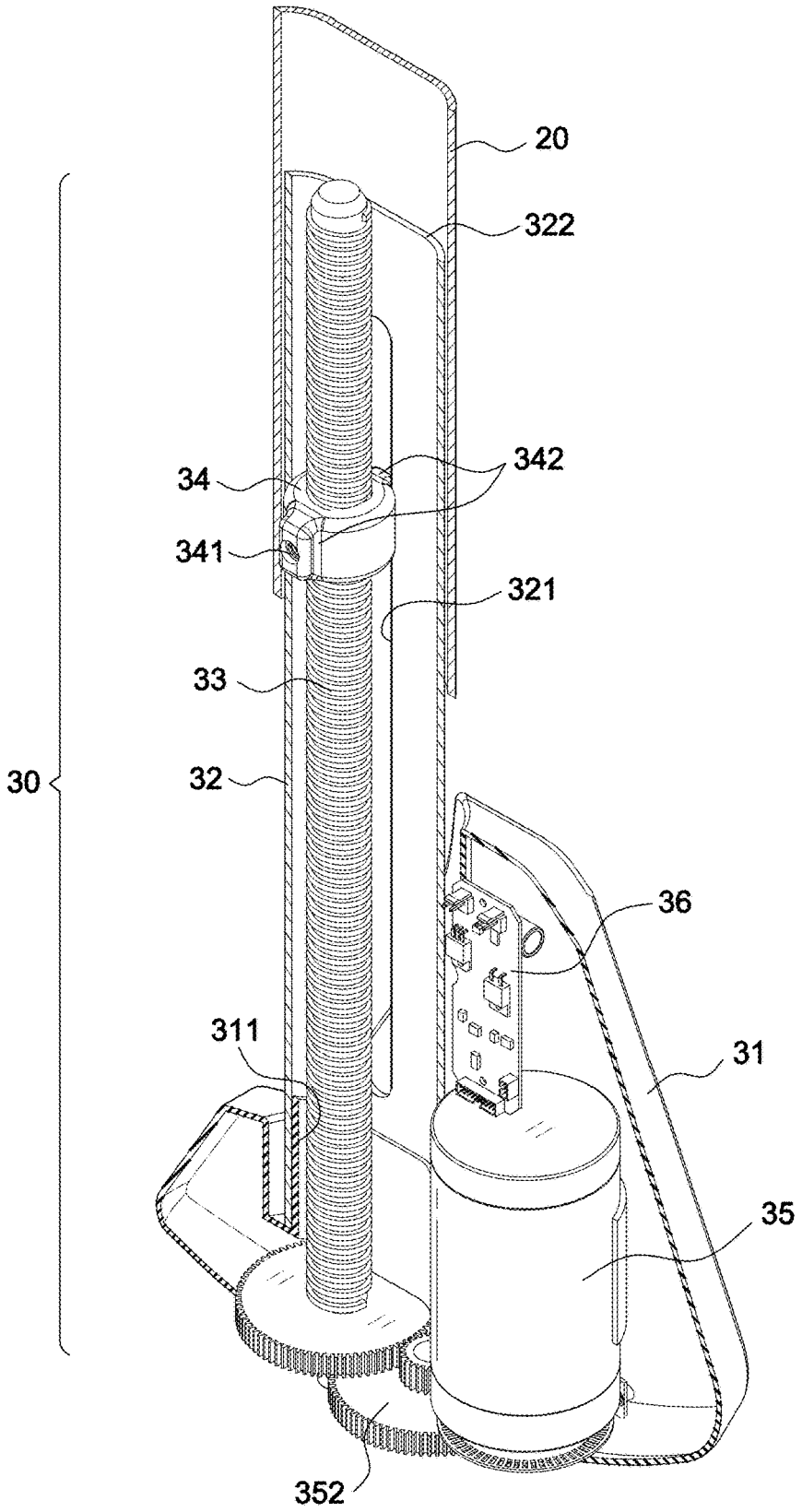
FIG. 9 is a perspective view of the gradient adjustment device and hollow tube of the present invention.
Figure 10A:
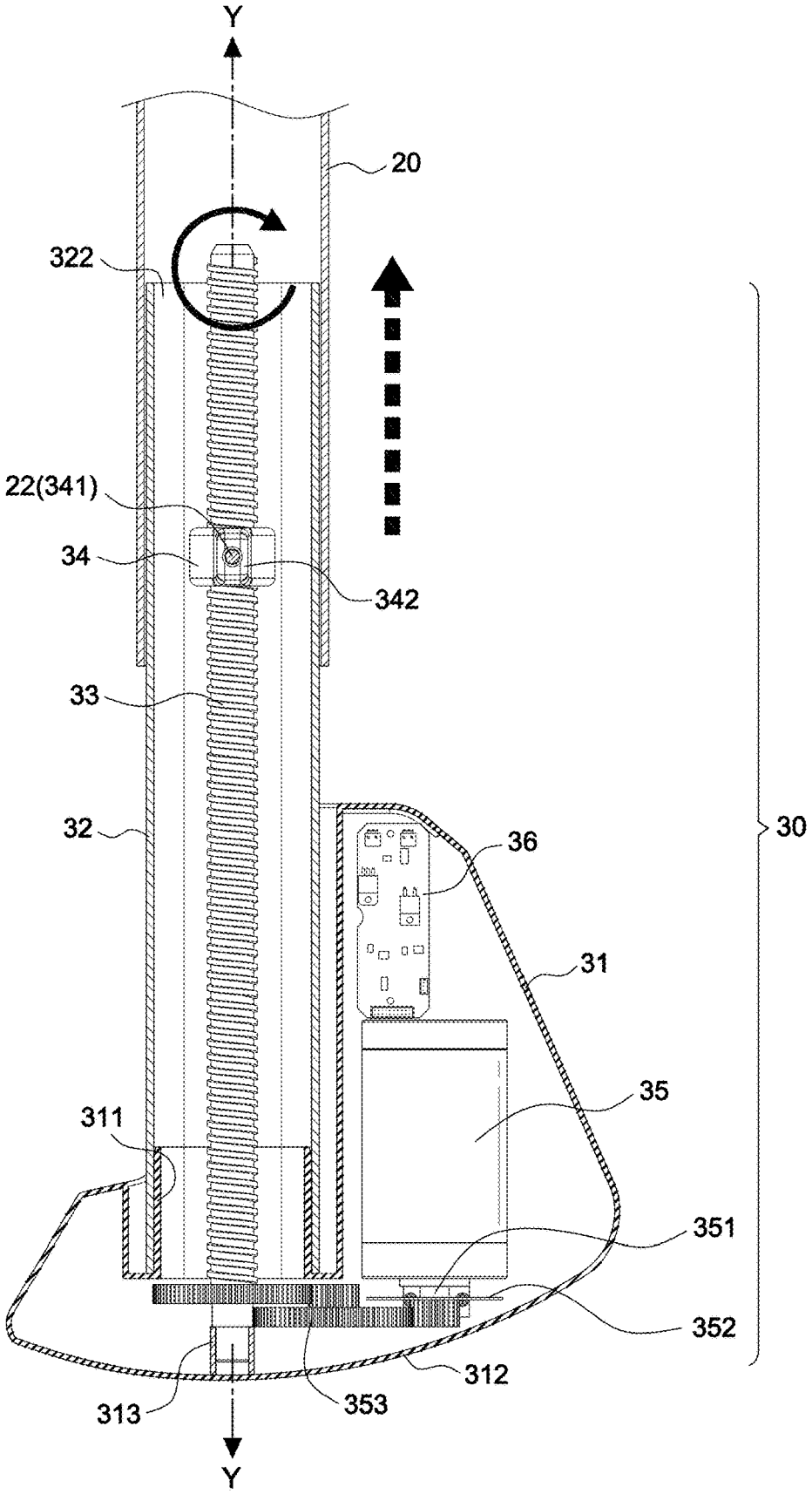
FIG. 10A is a schematic diagram illustrating the rising of the gradient adjustment device.
Figure 10B:
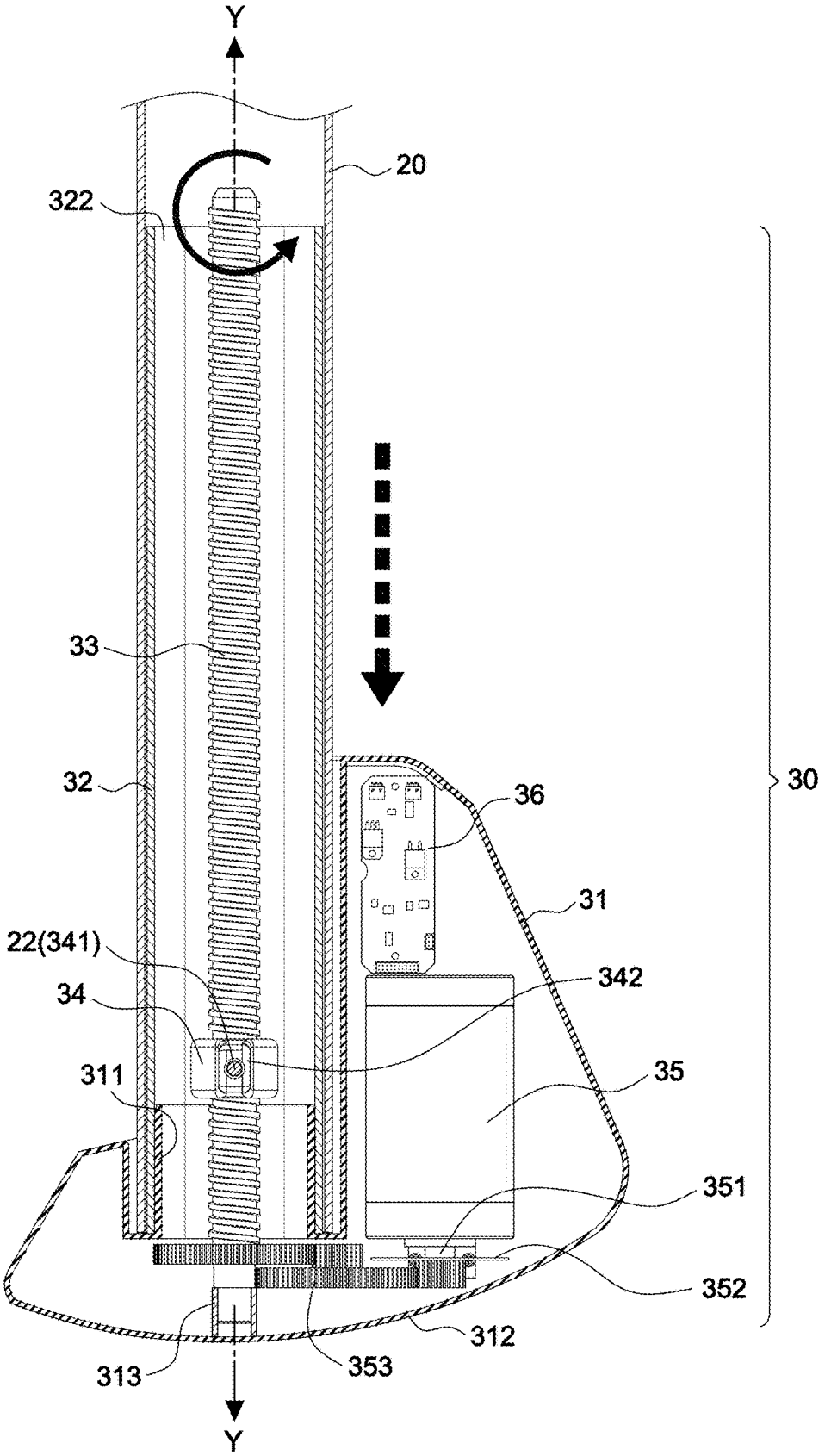
FIG. 10B is a schematic diagram illustrating the falling of the gradient adjustment device.

Referring to FIGS. 9~10B, a base seat 31 is arranged at the bottom end of the gradient adjustment device 30, its bottom surface is in contact with the ground, and its upper end surface is provided with an opening 311; In this embodiment, the bottom edge of the base seat 31 forwardly forms an arc surface 312.

A telescopic slide tube 32, its bottom end is fixed on the opening 311 of the base seat 31, and two axial slide grooves 321 are symmetrically provided on both sides, and its upper end extends 322 into the hollow tube 20 and can telescopically slide in the hollow tube 20;

An adjusting screw 33, arranged in the telescopic slide tube 32, and its bottom end is positioned in the base seat 31; In this embodiment, the bottom end of the adjusting screw 33 is sleeved on an axle seat 313. A nut 34, sleeved on the adjusting screw 33, and a screw hole 341 is provided on both sides of the nut 34 relative to the lock hole 21 of the hollow tube 20;

Two positioning screws 22 are used to fix the nut 34 on the inside of the hollow tube 20 through the lock hole 21 and the screw hole 341. In this embodiment, the nut 34 is symmetrically provided with two protruding parts 342 on both sides with the screw hole 341, and the two protruding parts 342 can slide up and down in the two axial slide grooves 321. In this way, when the adjusting screw 33 is rotating, the two protruding parts 342 of the nut 34 are restricted in the two axial slide grooves 321 and will not rotate accordingly. Therefore, the two axial slide grooves 321 can only slide up and down, thereby driving the hollow tube 20 to rise or fall.

A drive motor 35, arranged in the base seat 31 to drive the adjusting screw 33 to rotate forward or reverse; In this embodiment, referring to FIGS. 9~10B, the drive motor 35 is arranged at the front side of the base seat 31; a reduction gear set 353 is arranged between the bottom of the adjusting screw 33 and the drive motor 35, the drive motor 35 drives the adjusting screw 33 to rotate through the reduction gear set 353. But not limit to this, the drive motor 35 can also directly drive the adjusting screw 33.

An encoder 352, arranged around a shaft 351 of the drive motor 35, for sensing the rotational state of the drive motor 35; In this embodiment, the encoder 352 is arranged on the reduction gear set 353. The encoder 352 is a sensor used to measure physical quantities such as speed, position, or angle, and convert mechanical displacement into electrical signals, these features are well known in prior art, so will not be disclosed in detailed here.

A micro computer unit 36, arranged in the base seat 31 and electrically connect to the drive motor 35 and the encoder 36, for controlling the drive motor 35 to rotate forward or reverse, then further drive the adjusting screw 33 to rotate forward or reverse, so as to driving the nut 34 to move upward or downward relative to the adjusting screw 33, thereby causing the telescopic slide tube 32 to be in a telescopic state relative to the hollow tube 20; whereby the gradient adjustment device 30 can be telescopic on the axis (Y-Y) inside the hollow tube 20, so that the main frame 10 is raised or fell to simulate the situation of cycling uphill or downhill.

With the feature disclosed above, the gradient adjustment device 30 is driven by electricity, when the power is turned on, the drive motor 35 rotates to rotate the reduction gear set 353 and drive the adjusting screw 33 to rotate. At this moment, the encoder 352 will also rotate with the reduction gear set 353 to detect the position of the origin, and make the gradient adjustment device 30 stay at the origin. That is, in the virtual cycling software, the angle between the bicycle and the ground plane is zero degrees. This action is called origin return. When the origin return is completed, the drive motor 35 stops rotating and turn into a standby state.

Referring to FIG. 10A, which shows the rising of the gradient adjustment device 30. When the drive motor 35 rotates forward, the adjusting screw 33 is driven to rotate, thereby driving the nut 34 to move upward. The nut 34 is linked with the hollow tube 20, so the hollow tube 20 also rises upward. Similarly, referring to FIG. 10B, when the drive motor 35 rotates reversely, the adjusting screw 33 drives the nut 34 to fall, and the hollow tube 20 also fell.

Figure 11A:
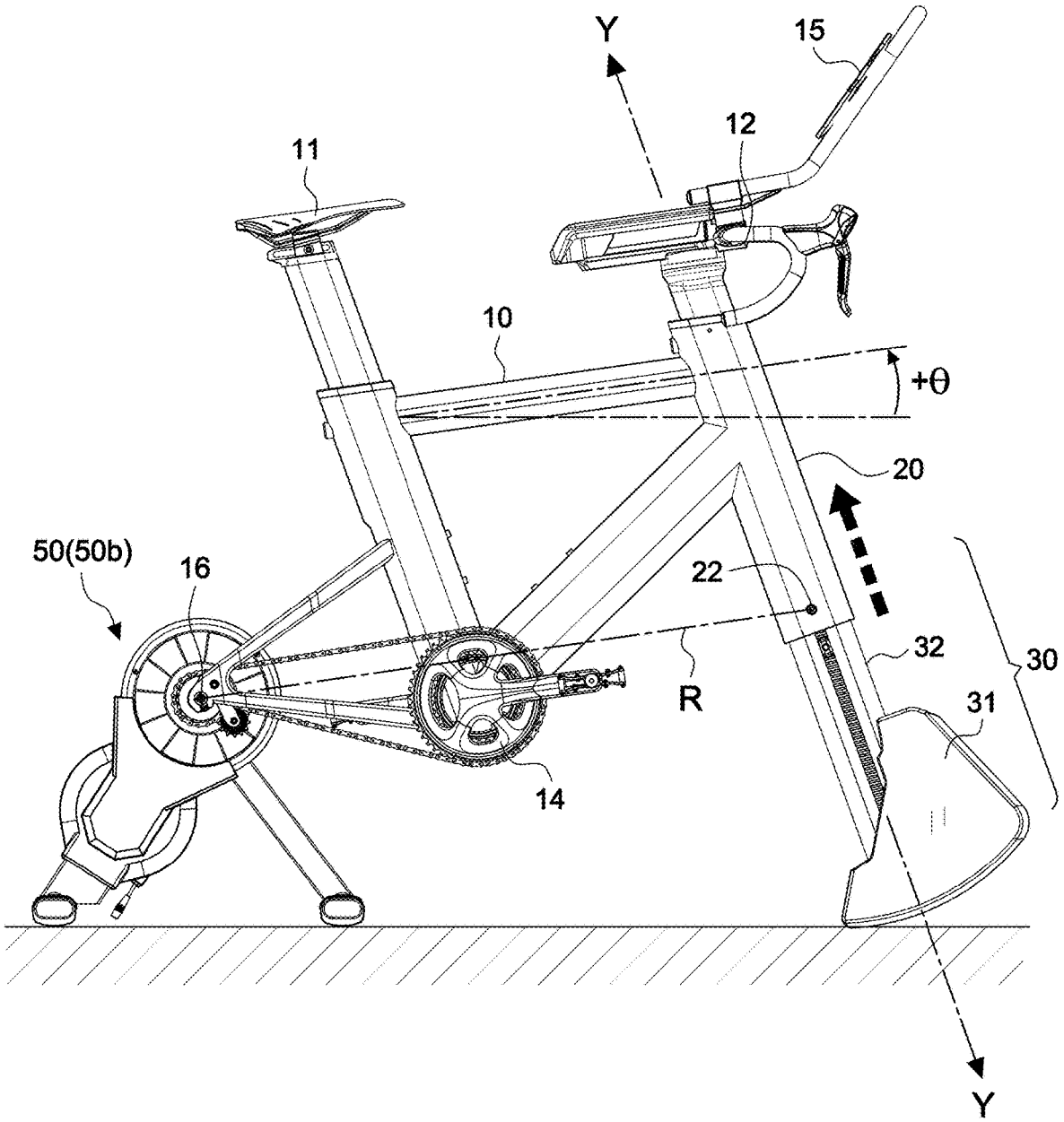
FIG. 11A is a schematic diagram illustrating the application of the gradient adjustment device while rising.
Figure 11B:
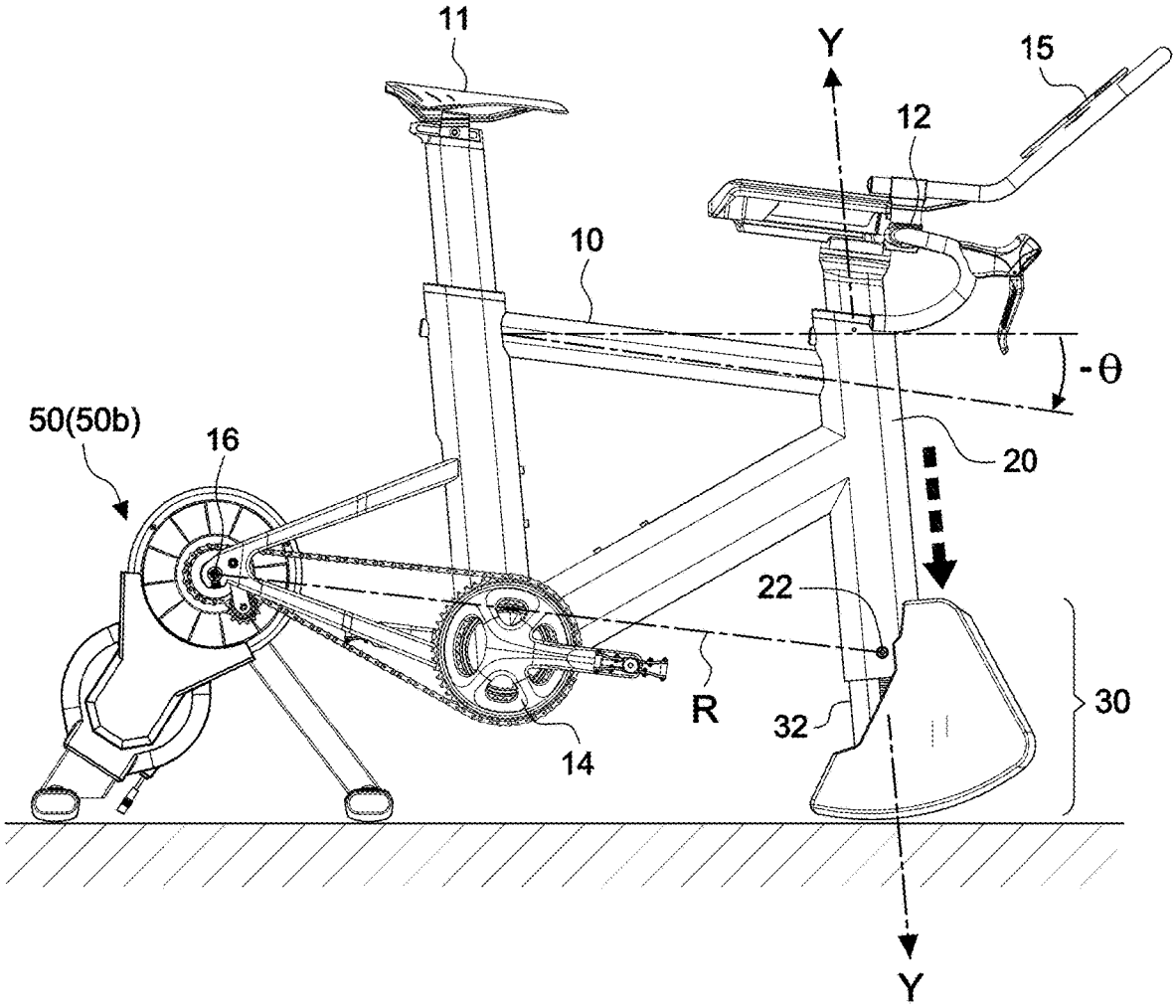
FIG. 11B is a schematic diagram illustrating the application of the gradient adjustment device while rising.

Referring to FIG. 11A, which shows the application of the gradient adjustment device 30. The action in FIG. 10A can make the front end of the main frame 10 rise with an angle of +θ. That is to say, the main frame 10 is centered on the bottom bracket 16, and the distance from the positioning screw 22 to the nut 34 is the radius (R), so that the main frame 10 can be extended on the axis (Y-Y) of the hollow tube 20 and rises with an angle of +θ. Similarly, referring to the action in FIG. 10B, FIG. 11B shows the gradient adjustment device 30 can make the main frame 10 fall on the axis (Y-Y) of the hollow tube 20 with an angle of −θ.

Figure 5:
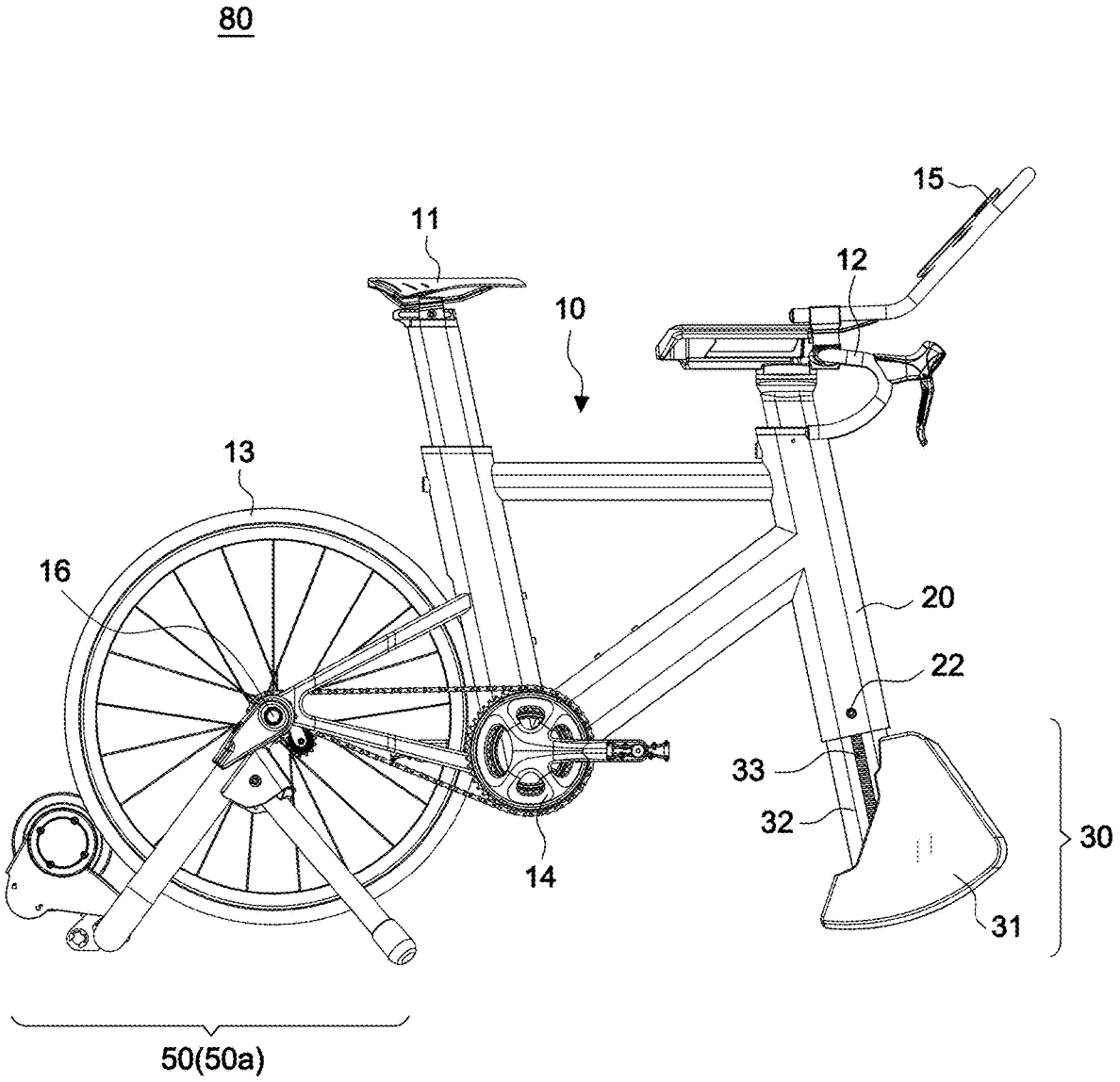
FIG. 5 is a side view of the preferred embodiment of the present invention combining with the wheel-on bike trainer.
Figure 6:
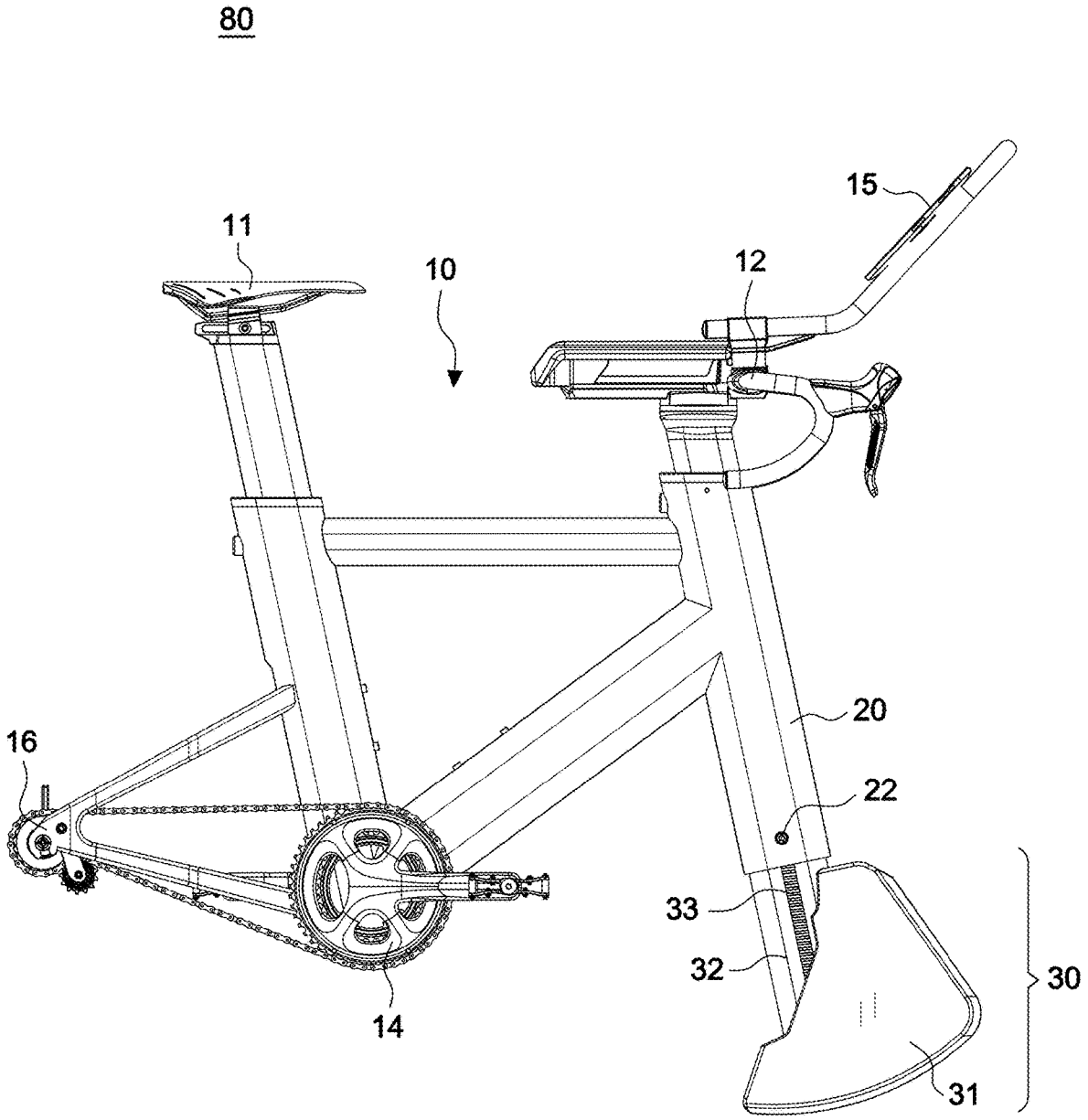
FIG. 6 is a side view of the preferred embodiment of the present invention while taking off the rear wheel.
Figure 7:
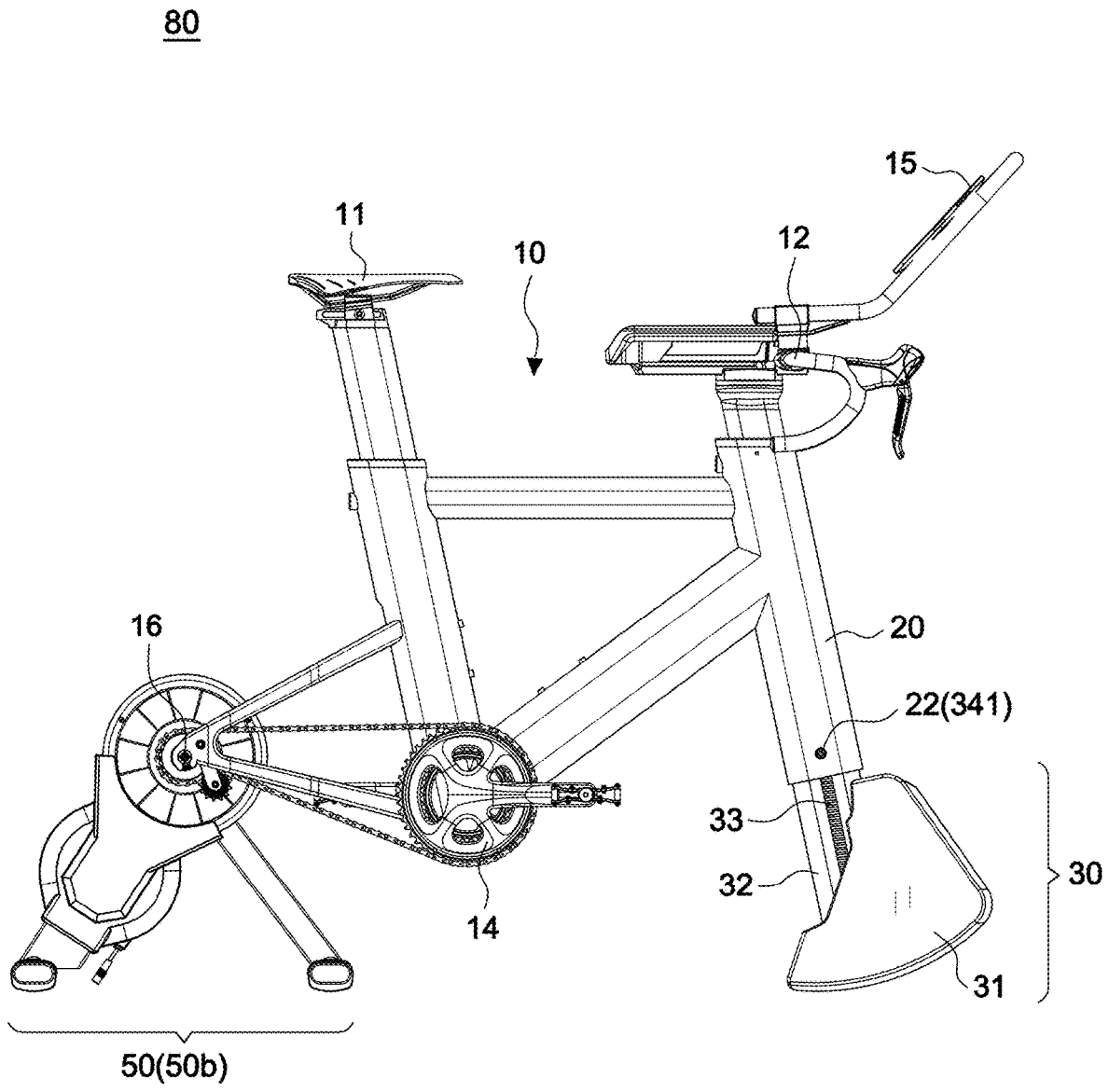
FIG. 7 is a side view of the preferred embodiment of the present invention combining with the direct-drive bike trainer.
Figure 8A:
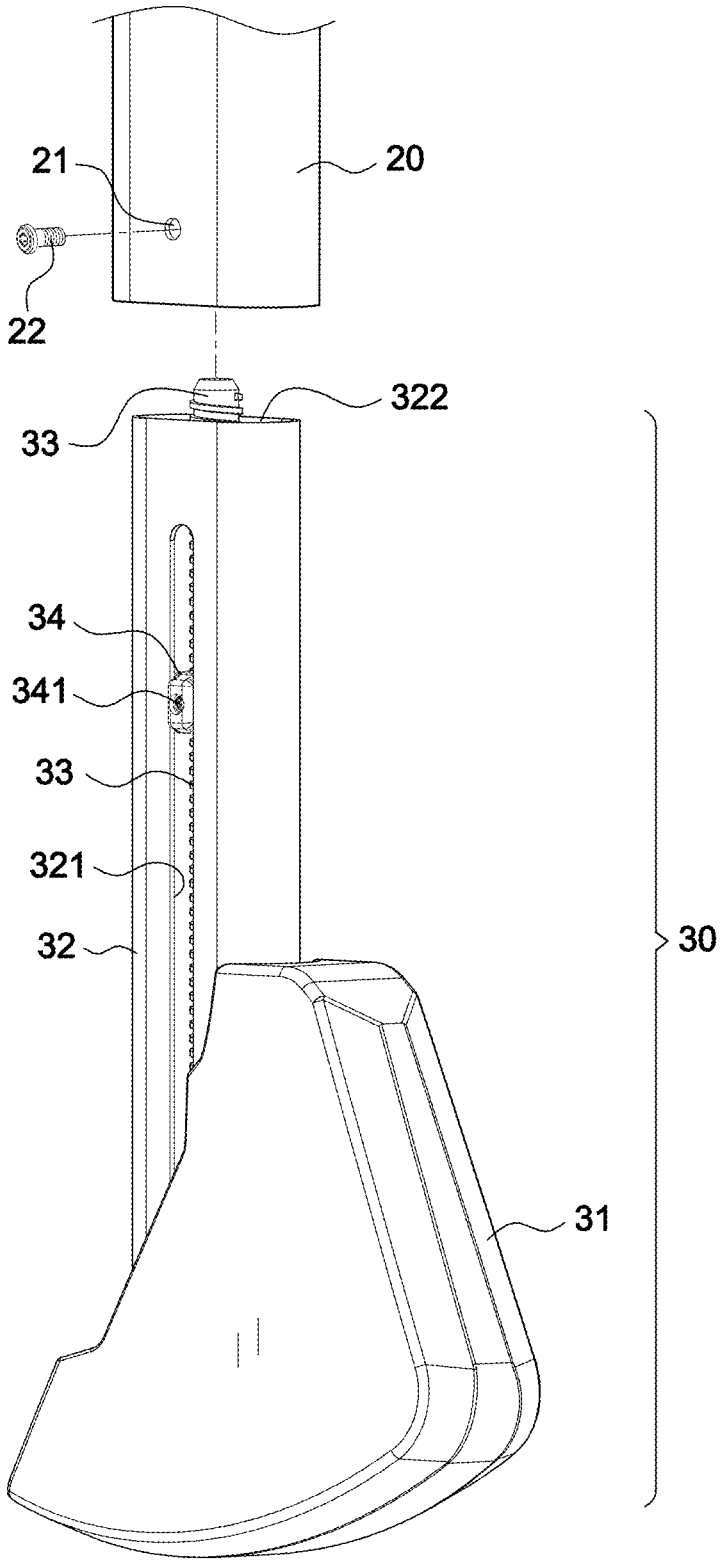
FIG. 8A is an exploded perspective view of the gradient adjustment device and hollow tube of the present invention.
Figure 8B:
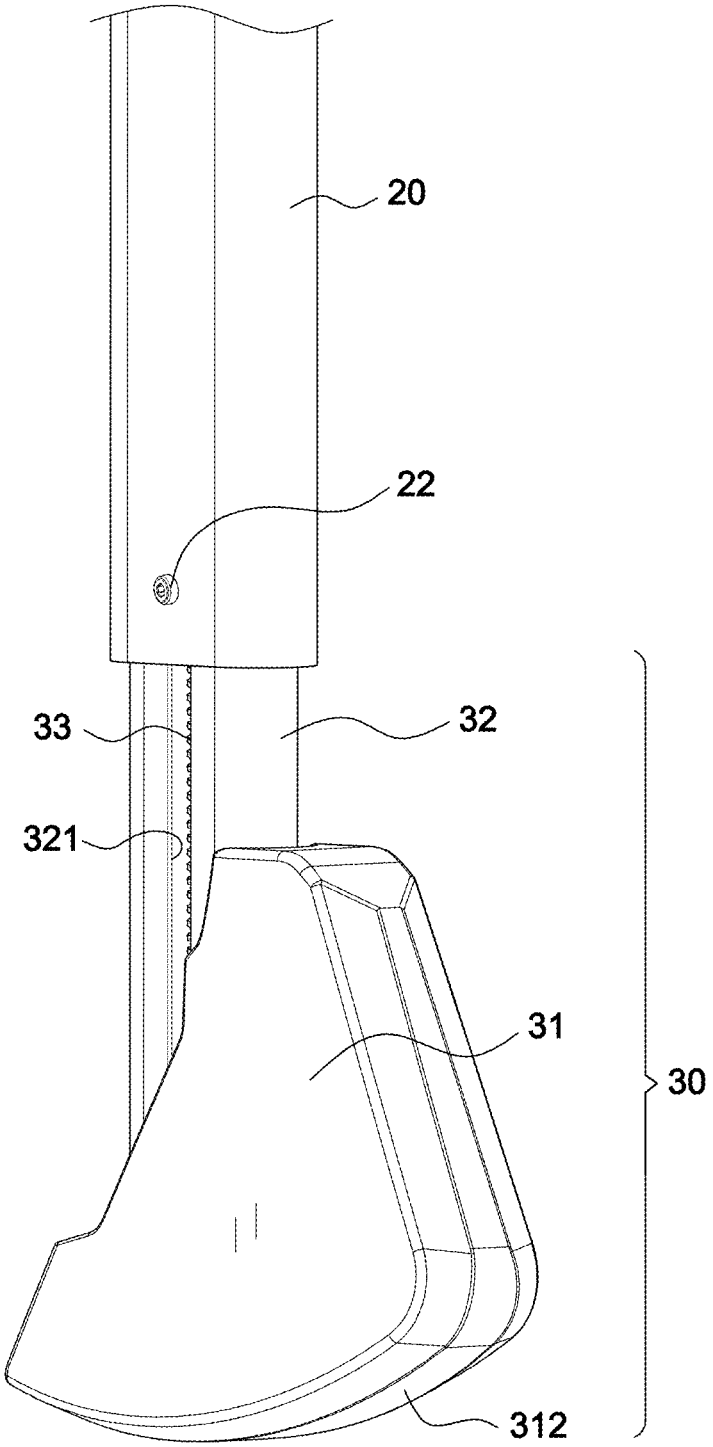
FIG. 8B is an assembly perspective view of the gradient adjustment device and hollow tube of the present invention.

Referring to FIG. 5, which discloses the application that the first embodiment combines with the wheel-on bike trainer 50*a*, but not limited to this application. Referring to FIG. 6, the rear wheel 13 can be taken off and combined with the smart bike trainer 50. Referring to FIG. 7, the rear wheel 13 can be taken off and let the bottom bracket 16 combine with the direct-drive bike trainer 50*b*.

Therefore, the present invention combines the gradient adjustment device 30 with the main frame 10, so the bike trainer does not require to install an independent climbing trainer 100; and this the main frame 10 with the gradient adjustment device 30 can be combined with the smart bike trainer 50 (50*a*, 50*b*), so as to form a complete training equipment.

Figure 12:
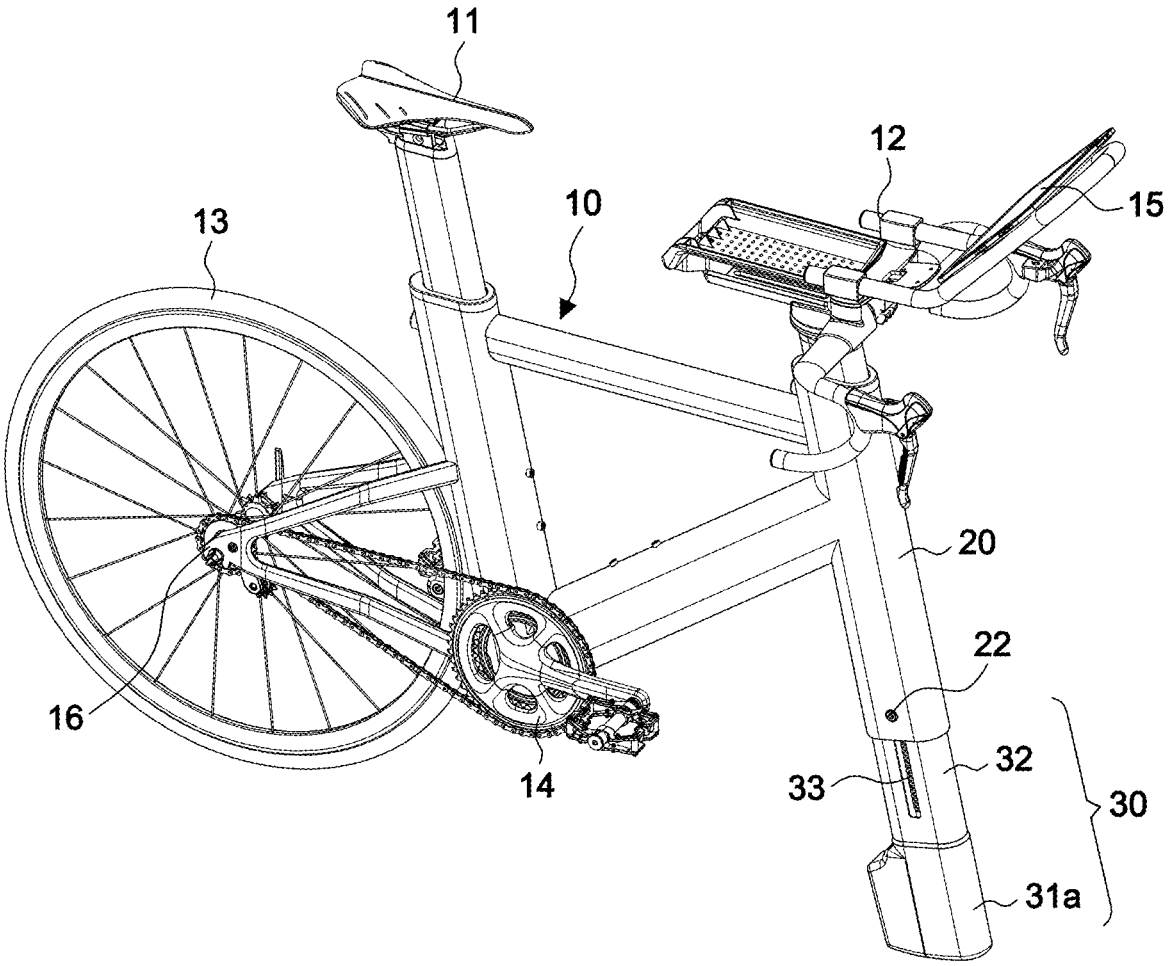
FIG. 12 is a prospective view of another embodiment of the present invention.
Figure 13:
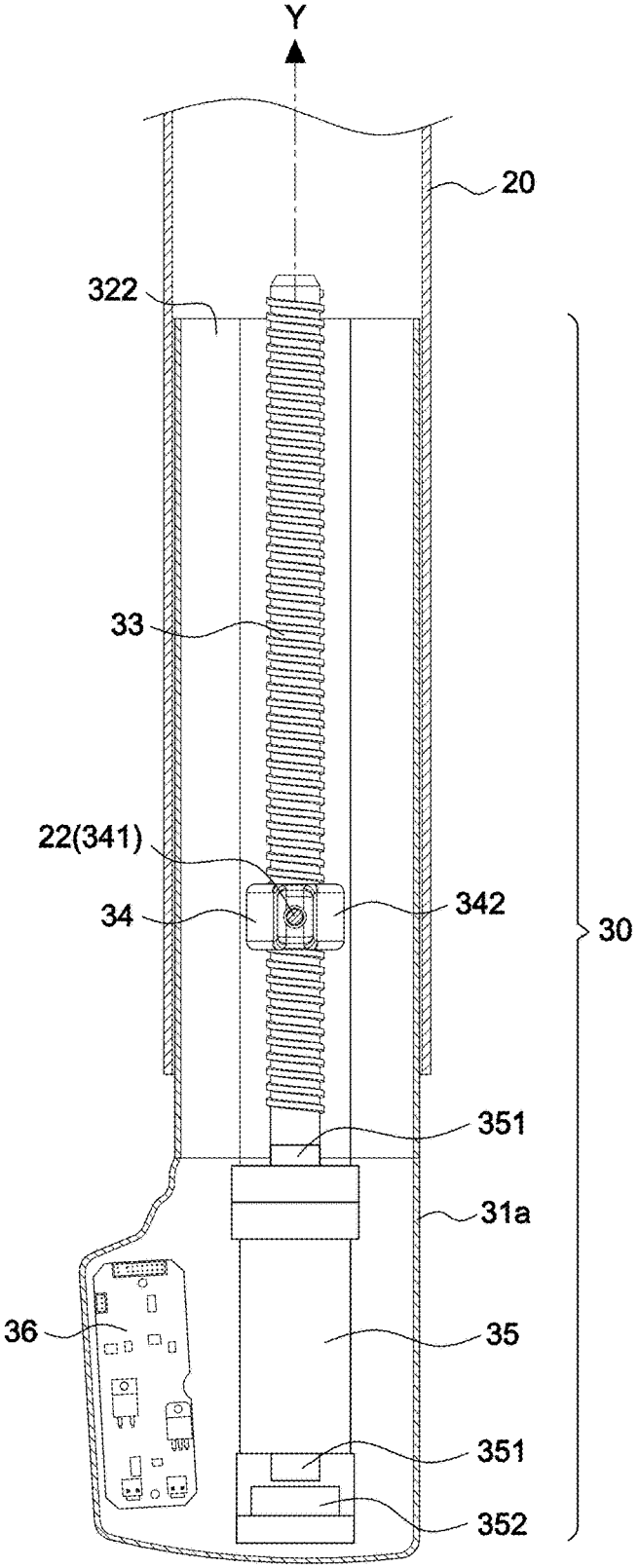
FIG. 13 is a sectional view of the gradient adjustment device of another embodiment of the present invention.

Referring to FIG. 12 and FIG. 13, which shows the second embodiment of the present invention, the units which same as the embodiment 1 are marked with same number, the differences are: the base seat 31*a* is smaller, and the shaft 351 of the drive motor 35 extends up and down; the upper shaft 351 directly drive the adjusting screw 33 without the reduction gear set 353, and the periphery of the bottom shaft 351 is set with an encoder 52, the micro computer unit 36 is arranged at the rear side of the base seat 31*a*. Accordingly, this embodiment has the same features and effects as the first embodiment, which will not be described again. The following operations are described using the first embodiment.

Figure 14:
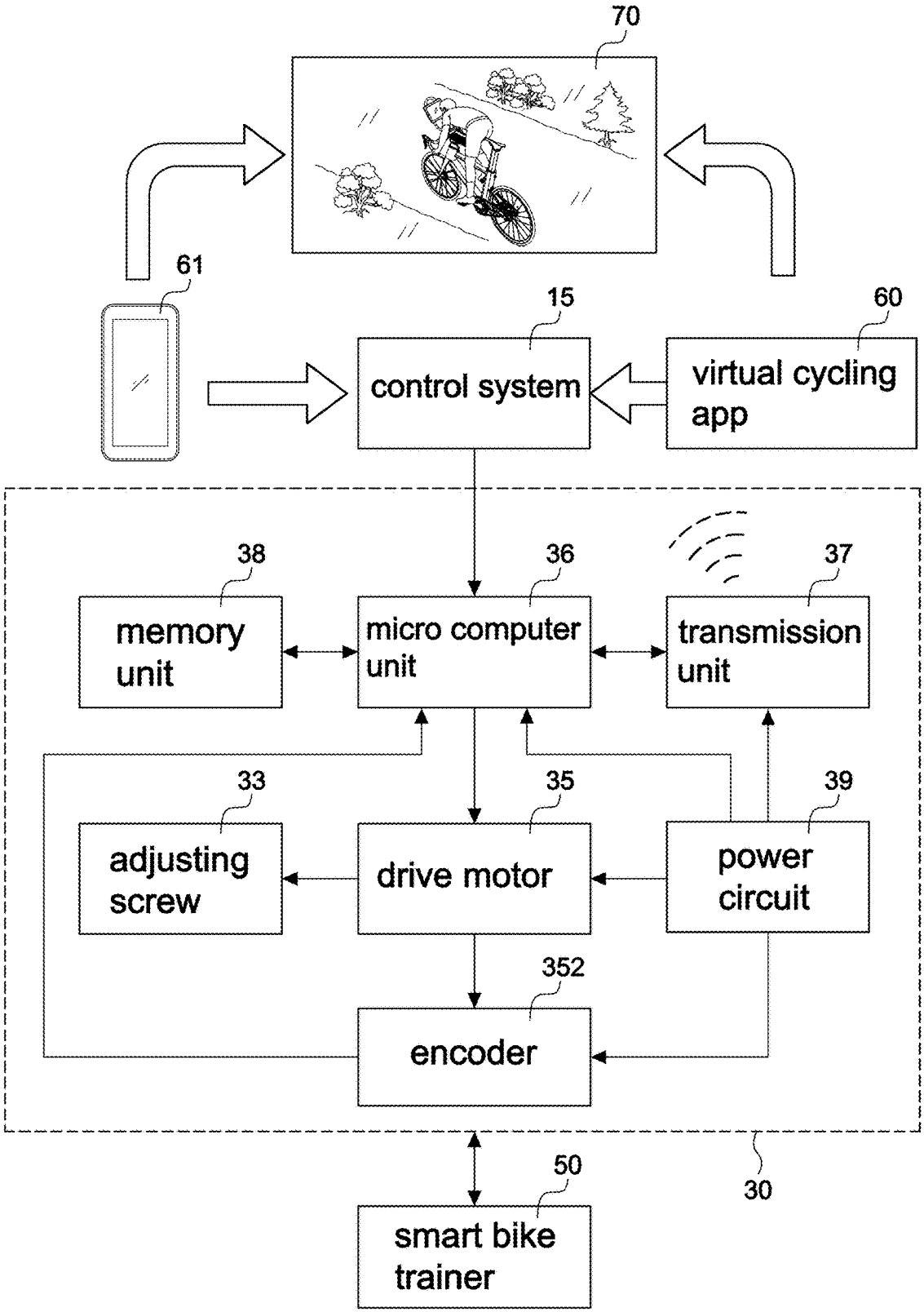
FIG. 14 is a block diagram illustrating the structure of the gradient adjustment device of the present invention.

Referring to FIG. 14, the adjustment device 30 includes a transmission unit 37 and a memory unit 38 electrically connected to the micro computer unit 36, and a power circuit 39 to provide the power required by the gradient adjustment device 30. Referring to FIG. 9, micro computer unit 36 can be in the form of a control circuit board. In this embodiment, further includes a control system 15 arranged on the main frame 10, the control system 15 is electrically connected to the micro computer unit 36. The smart bike trainer 50 can connect to the control system 15 and the micro computer unit 36.

Figure 15:
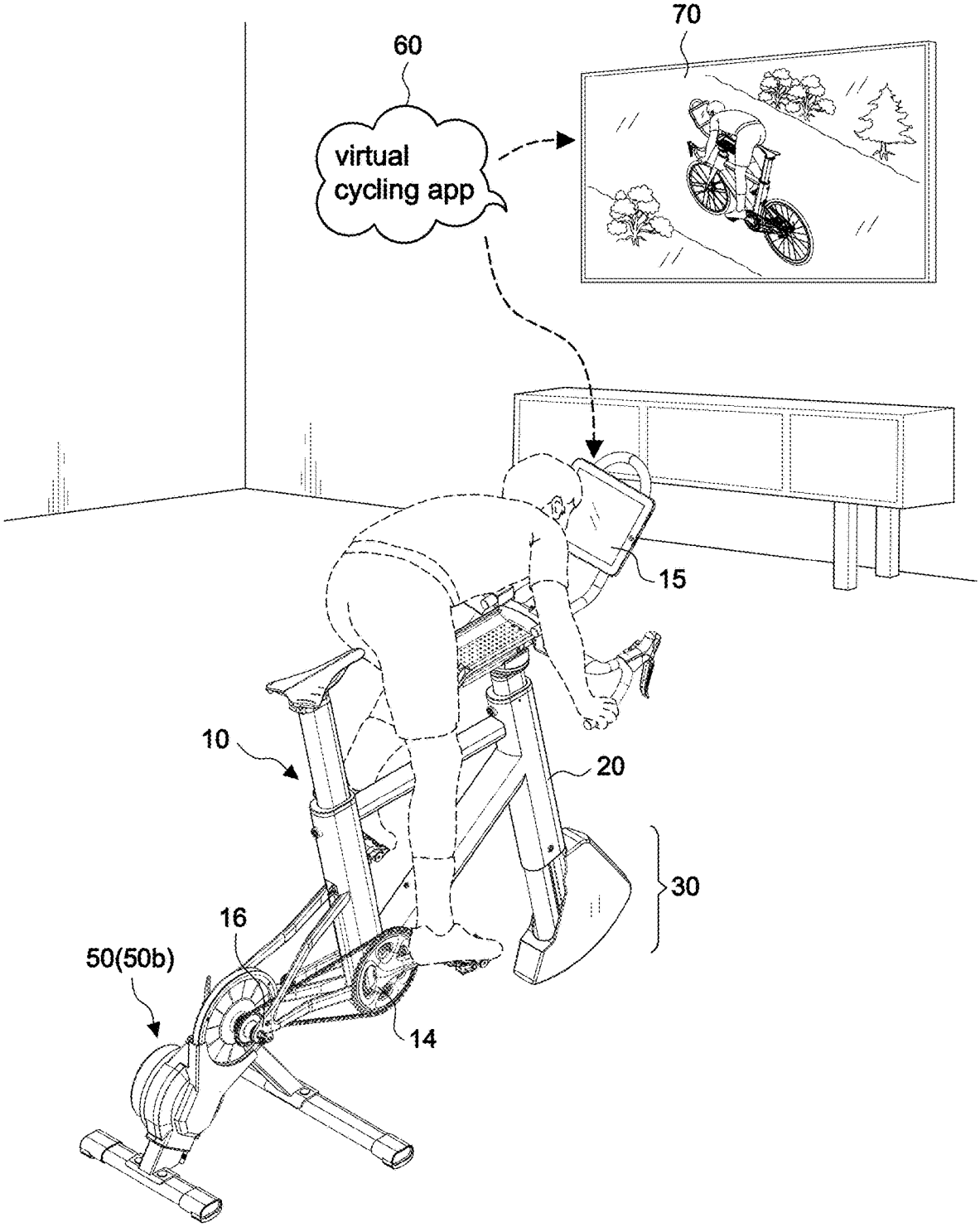
FIG. 15 is a schematic diagram illustrating the application of the present invention.

A virtual cycling software 60 can be operated by the control system 15 or smart phone, then it can be display on a monitor 70, the smart bike trainer 50 can also be connected with the virtual cycling software 60, accept the commands issued by the software, and control the smart bike trainer 50 according to the commands, so that the smart bike trainer 50 can do the actions (resistance) required by the virtual cycling software 60. Among the commands issued by the virtual cycling software 60, one of the commands is a real-time virtual gradient instruction. Because at different gradients, even at the same riding speed, the resistance that should be endured will vary with the gradient. Therefore, when the smart bike trainer 50 receives the commands, it will calculate the required output resistance based on the received commands, and thereby adjust the resistance of the smart bike trainer 50 to meet the requirements of the virtual cycling software 60, so as to meet the requirements of software virtual reality. FIG. 15 shows a schematic diagram illustrating the application of the present invention.

In addition to use the smart bike trainer 50 to control the resistance of the, some smart bike can simulate the angle of the bicycle relative to the ground plane at different gradient during real riding, allowing the rider to have a better virtual reality experience.

The above-mentioned gradient command is also used to control the included angle. This command can be transmitted to the smart bike trainer 50 in a wired or wireless way. The present invention is a bike trainer frame for a bike trainer that can respond to the gradient commands of the virtual cycling software 60 and can automatically adjust the angle with the ground plane according to the commands.

When the rider connects the device to the virtual cycling software (or game software) 60, the micro computer unit 36 will establish a message docking channel with the virtual cycling software (or game software) 60, then completes the origin return, and enters the standby state.

With the features disclosed above, the present invention below effects:

1. The present invention combines the gradient adjustment device 30 with the main frame 10, eliminating the requirement of installing another independent climbing training device as in the prior art, and has the effect of saving space.

2. Moreover, the gradient adjustment device 30 of the present invention is arranged on the same axis (Y-Y) as the hollow tube 20. Therefore, unlike the prior art, the feeling of displacement on the two axis (X-Y) is different. The present invention provides the feeling closer to the actual riding when going uphill and downhill.

3. The gradient adjustment device 30 of the present invention is not driven by a belt 226, but uses an adjusting screw 33, a nut 34 and an encoder 352 to adjust the gradient. Therefore, solving the disadvantage that the belt drive is easy to slip, and it has the effect of rapid adjustment and accurate gradient position.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bike trainer with auto gradient simulator, including:

a main frame, having a saddle and a handlebar;

a rear wheel, arranged at a rear side of the main frame, and the rear wheel can be taken off from the main frame;

a drive system, arranged on the main frame, for driving the rear wheel;

wherein:

a hollow tube extends downward from a front end of the main frame, and a symmetrical lock hole is provided on both sides of the hollow tube close to a bottom of the hollow tube;

a gradient adjustment device, sleeved on an axis of the hollow tube, including:

a base seat, arranged at a bottom end of the gradient adjustment device, its bottom surface is in contact with the ground, and its upper end surface is provided with an opening;

a telescopic slide tube, its bottom end is fixed on the opening of the base seat, and two axial slide grooves are symmetrically provided on both sides, and its upper end extends into the hollow tube and can telescopically slide in the hollow tube;

an adjusting screw, arranged in the telescopic slide tube, and its bottom end is positioned in the base seat;

a nut, sleeved on the adjusting screw, and a screw hole is provided on both sides of the nut relative to the lock hole of the hollow tube;

two positioning screws are used to fix the nut on the inside of the hollow tube through the lock hole and the screw hole;

a drive motor, arranged in the base seat to drive the adjusting screw to rotate forward or reverse;

an encoder, arranged around a shaft of the drive motor, for sensing the rotational state of the drive motor;

a micro computer unit, arranged in the base seat and electrically connect to the drive motor and the encoder, for controlling the drive motor to rotate forward or reverse, then further drive the adjusting screw to rotate forward or reverse, so as to driving the nut to move upward or downward relative to the adjusting screw, thereby causing the telescopic slide tube to be in a telescopic state relative to the hollow tube;

whereby the gradient adjustment device can be telescopic on the axis inside the hollow tube, so that the main frame is raised or fell to simulate the situation of cycling uphill or downhill.

2. The bike trainer with auto gradient simulator as claimed in claim 1, wherein a bottom edge of the base seat forwardly forms an arc surface.

3. The bike trainer with auto gradient simulator as claimed in claim 2, wherein the drive motor is arranged at a front side of the base seat, and a reduction gear set is arranged between a bottom of the adjusting screw and the drive motor, the drive motor drives the adjusting screw to rotate through the reduction gear set.

4. The bike trainer with auto gradient simulator as claimed in claim 1, further including a control system arranged on the main frame, the control system is electrically connected to the micro computer unit.

5. The bike trainer with auto gradient simulator as claimed in claim 1, wherein the gradient adjustment device further includes a transmission unit and a memory unit electrically connected to the micro computer unit, and a power circuit to provide the power required by the gradient adjustment device.

6. The bike trainer with auto gradient simulator as claimed in claim 1, wherein the nut is symmetrically provided with two protruding parts on both sides with the screw hole, and the two protruding parts can slide up and down in the two axial slide grooves.

7. The bike trainer with auto gradient simulator as claimed in claim 1, wherein the main frame can be combined with a wheel-on bike trainer.

8. The bike trainer with auto gradient simulator as claimed in claim 1, wherein the main frame can take off the rear wheel and be combined with a direct-drive bike trainer.

* * * * *